United States Patent [19]

Speraggi

[11] 4,346,883

[45] Aug. 31, 1982

[54] DOCUMENT POSITIONING AND FEEDING APPARATUS FOR HIGH SPEED PRINTERS

[75] Inventor: Marcello Speraggi, Milan, Italy

[73] Assignee: Honeywell Information Systems Inc., Waltham, Mass.

[21] Appl. No.: 182,165

[22] Filed: Aug. 28, 1980

[30] Foreign Application Priority Data

Aug. 30, 1979 [IT] Italy ..... 25357 A/79

[51] Int. Cl.[3] ..... B65H 5/02

[52] U.S. Cl. ..... 271/274; 226/185

[58] Field of Search ..... 271/273, 274; 226/185

[56] References Cited

U.S. PATENT DOCUMENTS

| | | | |
|---|---|---|---|
| 2,150,243 | 3/1939 | Page | 271/274 X |
| 2,593,157 | 4/1952 | Lorig | 226/192 |
| 3,073,590 | 1/1963 | Romeo | 271/274 |
| 3,246,822 | 4/1966 | Skeen | 271/273 X |

*Primary Examiner*—Richard A. Schacher

*Attorney, Agent, or Firm*—George Grayson; Nicholas Prasinos

[57] ABSTRACT

The present invention relates to document positioning and feeding apparatus for high speed printers, such as normally associated with data processing systems. The document feeding apparatus is particularly adapted to provide high quality, high speed printing of stock consisting of multiple pages or non-uniform thicknesses. It is useful for the printing of savings-books, checks and statement of account forms. The apparatus utilizes a unique coupling means to maintain equal and opposite rotation of the feeding elements and to substantially reduce relative rotary motion between the feeding elements during the feeding of stock into the printer. Novel support means allow the feeding elements to accommodate stock having a different thickness for one part of the stock compared to another part.

2 Claims, 3 Drawing Figures

DOCUMENT POSITIONING AND FEEDING APPARATUS FOR HIGH SPEED PRINTERS

BACKGROUND OF THE INVENTION

1. Field of the Invention

The present invention relates to document positioning and feeding apparatus for printers.

2. Description of Prior Art

High speed printers have been widely utilized in banks, credit companies and insurance companies. Users of high speed printers in these industries have specialized needs which include printing on different sizes and thicknesses of paper as encountered with checks, statement of account forms, and savings-books. In order to satisfy these needs it is necessary to provide a precise document feeding device, rather than the generally used pin wheel feeding device for uniformly sized printing stock. One form of precise feeding device consists of a feeding roller, like a typewriter roller, which cooperates with one or more pressure rollers as explained in U.S. Pat. No. 3,391,775. The printing stock is placed between the feeding roller and pressure rollers. Due to the friction between feeding roller and printing support, such printing stock can be fed in either direction by rotating the feeding roller, preferably by a "step" motor. However such a feeding device is not satisfactory particularly in printing multiple sheets of paper or printing papers having a non-uniform thickness. For example, if the contact friction between the multiple sheets is lower than the friction between a single sheet and the feeding roller, the single sheet tends to be advanced more than the other sheets in contact with the pressure roller. This produces a resisting action which opposes advancement thereby causing slippage which is prejudicial to the printing quality. In the case of printing stock of non-uniform thickness, for instance an open savings-book, such printing stock is pressed on the feeding roller by the pressure roller only on the thicker part of the book thereby causing slanted non-uniform feeding and poor quality printing.

SUMMARY OF THE INVENTION

The document positioner and feeder of the present invention overcomes these problems of the prior art.

The document feeding apparatus is formed by a back feeding roller element and a fore feeding roller element. Each element comprises a plurality of rollers. The roller elements are connected by a coupling means which provides equal and opposite rotation of the elements. The coupling means also eliminates the slipping present in the prior art document feeders by substantially preventing relative rotary motion between the elements during the insertion of printing stock. Support means are provided to allow the roller elements to be moved apart a variable distance in order to allow for the insertion therebetween of printing stock of non-uniform thickness.

The plurality of rollers of the fore feeding element are divided into two groups coupled by means of a universal joint. The universal joint preserves the speed and parallelism of the two groups of rollers, although the distance of each of the two groups of rollers from the back feeding roller element may be different. In such a way it is possible to print stock which has a non-uniform thickness. In a similar manner, dividing the plurality of rollers of the fore feeding element into several groups, it is possible to operate on printing stock with several thicknesses. The dimensions of the stock to be handled determine the length of the several groups of the rollers.

The applicant's document feeder is small and compact and therefore may be mounted on nearly all of the various printers available.

BRIEF DESCRIPTION OF THE DRAWINGS

These and other features of the present invention will appear more clearly from the following description of a preferred embodiment of the present invention and from the attached drawings where.

DESCRIPTION OF THE PREFERRED EMBODIMENT

Figure 1:
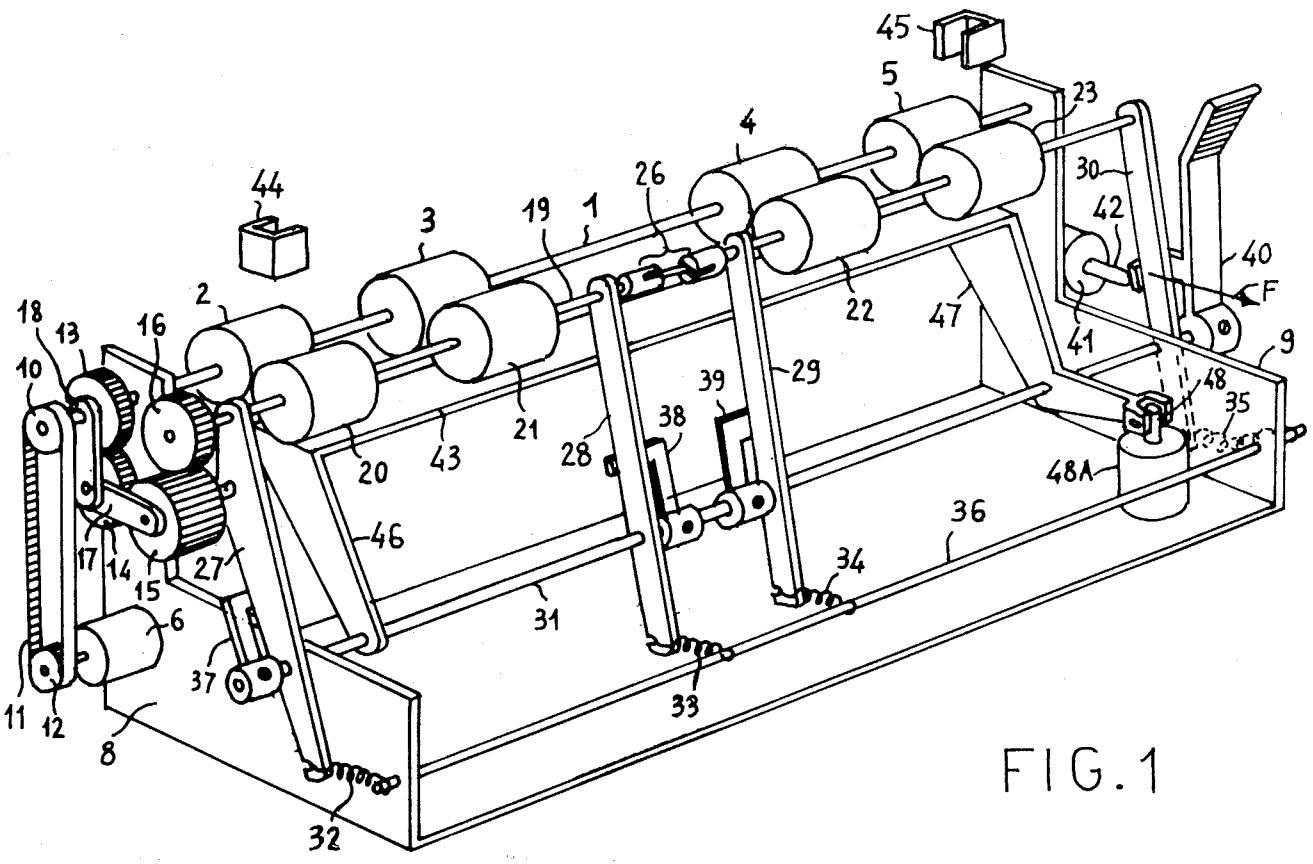
FIG. 1 is a schematic perspective view of the document feeder.

With reference to FIG. 1, the document feeder includes a back feeding roller element formed by a shaft 1 on which a plurality of rubber rollers 2, 3, 4, and 5 are firmly fixed. Shaft 1 is mounted in two bushings present in the side plates 8 and 9 of the document feeder frame and is free to rotate within such bushings. Rotation is imparted to shaft 1 by a toothed wheel 10 splined to such shaft. Toothed wheel 10 is driven by a toothed wheel 12 through a cog belt 11. The toothed wheel 12 is operated by a motor 6. A second gear 13 is also splined to shaft 1 and rotates gear 16 through intermediate coupled gears 14 and 15. The axis of rotation of gears 13, 14, 15, and 16 are parallel to one another. It is to be noted that the gears 14, 15, and 16 are also capable of translation, but the direction of their axis of rotation remains unchanged. In fact, gears 15 and 16 are pivoted on lever 27; gears 14 and 15 are connected by a bracket 17; and gear 14 is connected to gear 13 by a bracket 28.

The system of brackets and gears form a coupling means. Specifically the brackets form an articulated quadrilateral of gears securing the kinematic coupling among the several gears while allowing the relative shifting of the axis of rotation of the gears. Such coupling means will be considered in detail below.

Figure 2:
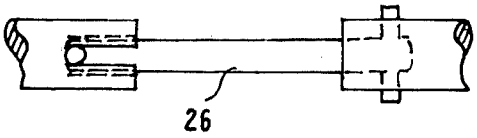
FIG. 2 illustrates in detail the universal joint disclosed in FIG. 1.

Gear 16 is splined to a fore feeding roller element shaft 19 on which rubber rollers 20, 21, 22, and 23 are firmly mounted. Rubber rollers 20, 21, 22, and 23 cooperate with the rollers 2, 3, 4, and 5 respectively of the back feeding roller element. Fore feeding shaft 19 is divided into two parts which are connected together by a universal joint 26. Universal joint 26 allows printing of stock which presents two side by side zones having different thicknesses, as for instance an open savings-book. Universal joint 26 also maintains the same rotational speed of the two parts of shaft 19. The universal joint is shown in detail in FIG. 2.

The two parts forming the fore feeding shaft 19 are supported at their ends by two pair of control levers 27, 28 and 29, 30 respectively which rotate upon a bar 31 pivoted on the frame sides. Suitable springs 32, 33, 34, and 35 are connected on one end to the lower end of such control levers 27, 28, 29, and 30. The opposite ends of such springs are restrained by a clamping bar 36 engaged into frame sides 8 and 9.

In normal printing condition, control levers 27, 28 29, and 30 press the fore feeding roller element against the back feeding roller due to the action caused by springs 32, 33, 34, and 35 respectively. Suitable arms 37, 38, 39, and 40 are firmly secured by means of screws onto bar 31, near the control levers 27, 28, 29, and 30. Such arms allow the rotation of bar 31 in moving the fore feeding roller element away from the back feeding roller element for the interposition of the printing stock. Such movement may be provided either manually by means of lever arm 40 or automatically by means of a thrust element 42 actuated in the direction of the arrow F by a control electromagnet 41.

A reference tile 43 and two lateral guides 44 and 45 for the printing support complete the document feeder. Reference tile 43, which is used for the initial vertical positioning of the printing stock, is supported through two arms 46 and 47 by bar 31 on which such arms are pivoted. One of the arms is coupled to a thrust element 48 actuated by a two position control electromagnet 48A.

In rest condition, the tile 43 is placed directly under the feeding elements so that the printing stock, interposed between the suitably-spaced feeding elements, is positioned with its lower edge against the tile. In working condition produced by the energization of electromagnet 48A, tile 43 assumes a retracted position which does not interfere with the downward vertical movement of the printing stock. The two lateral guides 44 and 45 are used for the lateral positioning of the printing stock.

Figure 3:
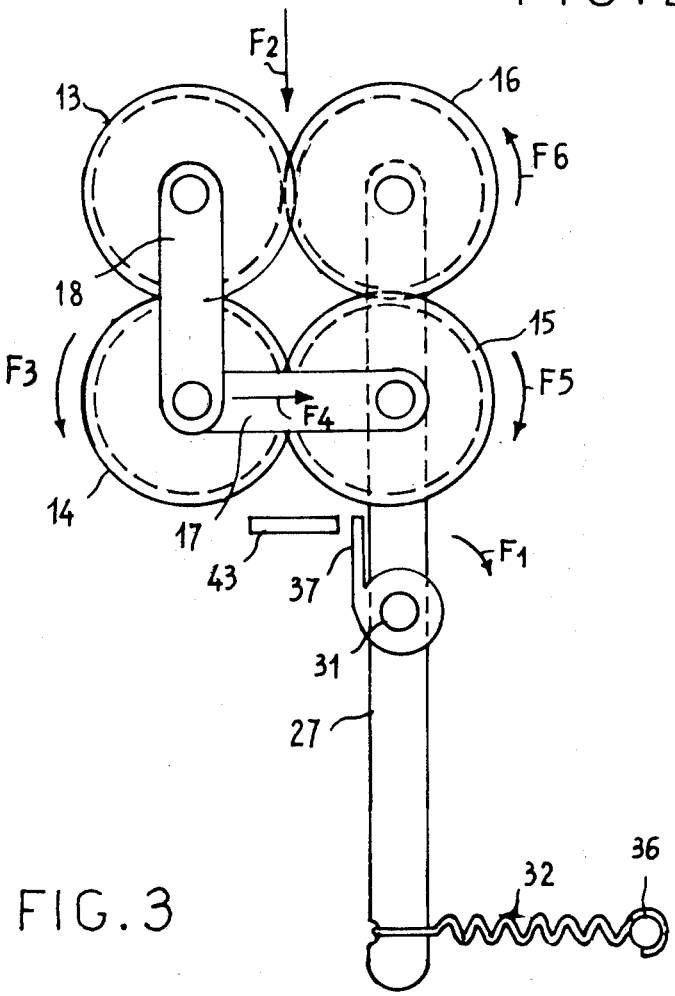
FIG. 3 illustrates in detail the coupling means disclosed in FIG. 1.

FIG. 3 is a detailed side view of the coupling means which couples the fore feeding roller element to the back feeding roller element. Gear 13, splined to the back feeding shaft 1 and whose rotational axis is fixed relative to the support means, acts as the driving gear of the coupling means. Gear 14 is positioned in coupling with gear 13 by means of bracket 18 and with gear 15 by means of bracket 17. Gears 15 and 16, coupled together, are mounted on control lever 27 which in turn pivots on bar 31. As shown in FIG. 1, the gears 13 and 16 are located in different planes, so that they are not coupled together. The transmission ratio of the gear system which includes gears 13, 14, 15, and 16 must be such as to give the same peripheral speed to the two pluralities of the fore and back feeding rollers.

In the preferred embodiment of the document feeder, the fore feeding rollers have their diameter equal to the one of back rollers and the gears, all equal to each other, have their pitch diameter equal to the one of the feeding rollers. By pulling on the lower end of control lever 27, spring 32, secured to bar 36, positions the fore feeding roller element (which corresponds to gear 16) to press upon the back feeding roller element (which corresponds to gear 13). For allowing the insertion of the printing stock between the feeding rollers of the two elements, arm 37 engages the control lever 27 and rotates it on bar 31 in the direction of arrow F1. Correspondingly, gear 16 moves away from gear 13 and the fore feeding roller element moves apart from the back feeding roller element. The printing stock is inserted between the rollers of the two feeding elements according to the direction of arrow F2 and is vertically positioned by reference tile 43. As soon as the action of arm 37 terminates, spring 32 on level 27 presses the fore feeding roller element against the back feeding roller element thus locking the inserted printing stock in position.

During the operation of spreading apart the elements, gear 14, in order to translate in the direction of arrow F4, rotates in the direction of arrow F3, transmitting such rotation to gear 15 (which in turn rotates in the direction of arrow F5) and then to gear 16 (which in turn rotates in the direction of arrow F6). Such rotation of the gears occurs during the rotation of the shafts of gears 15 and 16 about the axis of the bar 31. It is noted that gear 16 rotates in a direction opposite to F6 as it is rotated about the axis of bar 31, but this movement is not sufficient to neutralize the F6 rotation. During the operation of bringing the two feeding elements together, the phenomenon occurs in the opposite way so that the rollers corresponding to gear 16 come in contact with the printing stock with a component of rotary motion; in the case where the printing support is formed of several sheets, this causes a certain slipping.

According to another aspect of the present invention, such slipping phenomenon is eliminated by a suitable choice for the rotation center of control lever 27.

The preferred embodiment is shown in FIG. 3, where the several gears have the same pitch diameter (equal to one of the feeding rollers), their rotation centers are substantially placed to the apexes of a square and the rotation center of control lever 27 is placed on the line defined by the rotation centers of gears 15 and 16, at a distance from the rotation center of gear 15 equal to the diameter of the gears.

Furthermore, such distance may be suitably increased, as long as at the same time the rotation of control lever 27 shifts suitably (with reference to FIG. 3) toward the right side of such figure. In such case the relative translation between the rollers of the fore feeding element and the rollers of the back feeding element occurs not perpendicular to the plane of the print stock (identified by arrow F2), but inclined with respect thereto. Such displacement between the elements also includes a component of rotary motion such that the resulting movement of the fore feeding element is perpendicular to the contact plane (F2) in which the printing stock lies, thus avoiding the inconvenience of any initial slipping.

It is to be noted that while in the previous description reference has been made to a back feeding roller element rotating around a fixed axis, while the fore feeding roller element is capable to translation, such arrangement of the two elements is interchangeable.

What is claimed is:

1. In a document feeder apparatus for a printer comprising:

back feeding roller element;

fore feeding roller element;

support means for said roller elements, said support means aligning the axis of rotation of said fore feeding element with the axis of rotation of the back feeding elements, said support means maintaining said roller elements in resilient contact with one another, said support means allowing parts of said roller elements to assume a different distance therebetween while maintaining the axis of rotation of the parts parallel to each other; and coupling means connecting said back feeding roller element to said fore feeding roller element, said coupling means being operable to provide equal and opposite rotation of said roller elements, said coupling means further being operable to substantially prevent relative rotary motion between said elements during the feeding of stock into the printer;

whereby one of said feeding elements is divided in at least two parts having parallel shafts, the shafts of said two parts being coupled by a universal joint which secures for the two parts identical acts of rotary motion, and said support means allowing the shafts of said two parts to be positioned at different distances from the shaft of the other of said feeding element.

2. A document feeder apparatus as claimed in claim 1 whereby said coupling means comprises a system of four gears, a first gear being splined to the shaft of one of said feeding elements, a fourth gear being splined to a shaft of the other of said feeding elements, a second gear being meshed with said first gear, a third gear being meshed with said second and said fourth gear, said coupling means including an articulated system of arms which allows a change in the distance of the shaft of one of said feeding elements from the shaft of the other of said feeding elements between a contact position and an open position, in said contact position the feeding elements are in contact with one another and define a contact plane between said elements, said coupling means being operable to provide movement of said one of said feeder elements perpendicular to the contact plane during the return of said element from the open position to the contact position.

* * * * *